US005603496A

United States Patent [19]

Rappaport

[11] Patent Number: 5,603,496

[45] Date of Patent: Feb. 18, 1997

[54] BASKETBALL GOAL OF ADJUSTABLE HEIGHT

[76] Inventor: Mark Rappaport, 4999 Smith Canyon Ct., San Diego, Calif. 92130

[21] Appl. No.: 391,454

[22] Filed: Feb. 21, 1995

[51] Int. Cl.[6] ..... A63B 63/08

[52] U.S. Cl. ..... 473/487; 248/284.1

[58] Field of Search ..... 273/1.5 R; 248/281.11, 248/284.1

[56] References Cited

U.S. PATENT DOCUMENTS

| | | | |
|---|---|---|---|
| 2,313,188 | 3/1943 | Woodburn | 273/1.5 R |
| 2,517,463 | 8/1950 | Cobb | 273/1.5 R |
| 4,145,044 | 3/1979 | Wilson et al. | 273/1.5 R |
| 4,365,802 | 12/1982 | Ehrat | 273/1.5 R |
| 4,395,040 | 7/1983 | White | 248/284.1 X |
| 4,723,777 | 2/1988 | Jolly | 273/1.5 R |
| 4,781,375 | 11/1988 | Nye | 273/1.5 R |
| 4,793,611 | 12/1988 | Thornell | 273/1.5 R |
| 4,846,470 | 7/1989 | Peterson | 273/1.5 R |

FOREIGN PATENT DOCUMENTS

| | | | |
|---|---|---|---|
| 94/16779 | 8/1994 | WIPO | 273/1.5 R |

*Primary Examiner*—Paul E. Shapiro

*Attorney, Agent, or Firm*—Panitch Schwarze Jacobs & Nadel, P.C.

[57] ABSTRACT

A basketball goal for indoor play in an area bounded by a wall having an access door set therein, the height of the goal being adjustable to a desired elevation. The goal includes a hoop from which a net is suspended, the hoop being supported on a fixture attached to the front section of a pantograph whose rear section is provided with a mounting bracket that hitches onto the upper edge of the door, whereby the hoop projects outwardly from the wall in a horizontal plane. The pantograph is angularly adjustable to raise or lower the front section thereof with respect to the rear section while maintaining these sections in parallel relation whereby the hoop may be set to an elevation suitable for play.

7 Claims, 5 Drawing Sheets

BASKETBALL GOAL OF ADJUSTABLE HEIGHT

BACKGROUND OF INVENTION

1. Field of Invention

This invention relates generally to basketball goals, and more particularly to a goal for indoor play in a play area bounded by a wall having an access door, the goal from which a net is suspended being supported by means of an adjustable pantograph on the upper edge of the door so that the hoop may be set to an elevation suitable for play.

2. Status of Prior Art

The game of basketball, played throughout the world both indoors and outdoors by professionals and amateurs, makes use of a basketball and two goals, one for each end of a playing court. The goal includes a ring or hoop from which a mesh net is suspended, the net acting to momentarily check the basketball as it passes therethrough. The hoop is mounted on an elevated backboard, often formed of tempered glass.

The normal practice is to rigidly mount the hoop so that it is horizontal and extends forwardly from the vertical backboard. This mounting must be sufficiently rigid so that the hoop is capable of withstanding forces applied thereto by a player during a game. These forces are created by the ball bouncing on the hoop or by players coming in contact with the hoop.

In recent years, as players have become taller, the goal has been subjected to increasing abuse as a result of contact with players, giving rise not only to damage to the hoop but also, in some instances, to injury to the player.

A common tactic in playing basketball is the so-called "slam dunk shot," in which the player jumps upwardly with the ball held in his outstretched arms and hands, the ball then being driven downwardly through the hoop. In carrying out this dunk shot, the player makes forceful contact with the hoop by slapping, hitting or pulling the hoop with his hands, wrists or arms.

When the hoop is rigidly mounted, the forces exerted on the hoop by various executions of a slam dunk shot may cause deformation of the hoop. A more serious problem is that the glass backboard on which the hoop is mounted will sometimes shatter under the forces arising from this shot.

One prior art solution to the problem is to provide, as disclosed in the Mahoney et al. U.S. Pat. No. 4,767,503, a breakaway mounting assembly in which the hoop, when subjected by the player to an excessive force, then simply collapses or breaks away from its normal position on the backboard. The drawback to this arrangement is that it interrupts the game which cannot be resumed until the goal is reassembled.

An approach to this problem that is of greater prior art interest with respect to the present invention is that disclosed in the Tyner U.S. Pat. No. 4,194,734, in which the hoop of the goal is joined to a spring-biased bracket, so that when a player executes a slam dunk shot and comes in contact with the hoop, the hoop then swings down from its normal horizontal position to absorb the resultant shock.

In all of the above cited prior art patents, the mounting for the hoop which permits deflection of the hoop to absorb a downward force applied thereto is a relatively complicated mechanism that is expensive to manufacture and requires adjustment or maintenance for proper operation.

Portable basketball goals are known which are adapted to be used in indoor play by children. Such goals consist of a hoop supported by a bracket on a vertical stand anchored on a weighted base, a cardboard backboard being held by the bracket above the stand. This known arrangement is relatively unstable, not only because the stand may be upset by a child crashing into it in play, but also because the backboard supported above the stand is incapable of coping with a basketball thrown against it with more than modest force.

Moreover, such portable goals are incapable of absorbing a downward force applied by a player to the hoop, and the goal, therefore, cannot survive hard play. Also, because the hoop is not deflectable, it may cause injury to a child who hits the hoop with his hand or wrist.

SUMMARY OF INVENTION

The main object of this invention is to provide a basketball goal of adjustable height for indoor play in a play area bounded by a wall having a door set therein the goal being supported on the upper edge of the door.

A significant advantage of a goal in accordance with the invention is that it may be adjusted so that it is either above or below the upper edge of the door whereby the goal may be set to an elevation suitable for play.

More particularly, an object of this invention is to provide a basketball goal of the above type in which the hoop of the goal supported on a spring-biased fixture is normally maintained in a horizontal plane in front of the door on which the goal is supported, the hoop being deflected momentarily when a downward force is applied thereto by a player, thereby absorbing this force to prevent injury to the player and damage to the goal.

Also an object of this invention is to provide a goal whose hoop and the mounting fixture therefor are both molded of low cost, synthetic plastic material of high Strength, whereby the goal is capable of surviving rough handling by children.

Briefly stated, these objects are being attained by a basketball goal for indoor play in an area bounded by a wall having an access door set therein, the height of the goal being adjustable to a desired elevation. The goal includes a hoop from which a net is suspended, the hoop being supported on a fixture attached to the front section of a pantograph whose rear section is provided with a mounting bracket that hitches onto the upper edge of the door, whereby the hoop projects outwardly from the wall in a horizontal plane. The pantograph is angularly adjustable to raise or lower the front section thereof with respect to the rear section while maintaining these sections in parallel relation whereby the hoop may be set to an elevation suitable for play.

BRIEF DESCRIPTION OF DRAWING

For a better understanding of the invention, as well as other objects thereof, reference is made to the following detailed description of the invention to be read in conjunction with the accompanying drawings in which.

DESCRIPTION OF INVENTION

Figure 1:
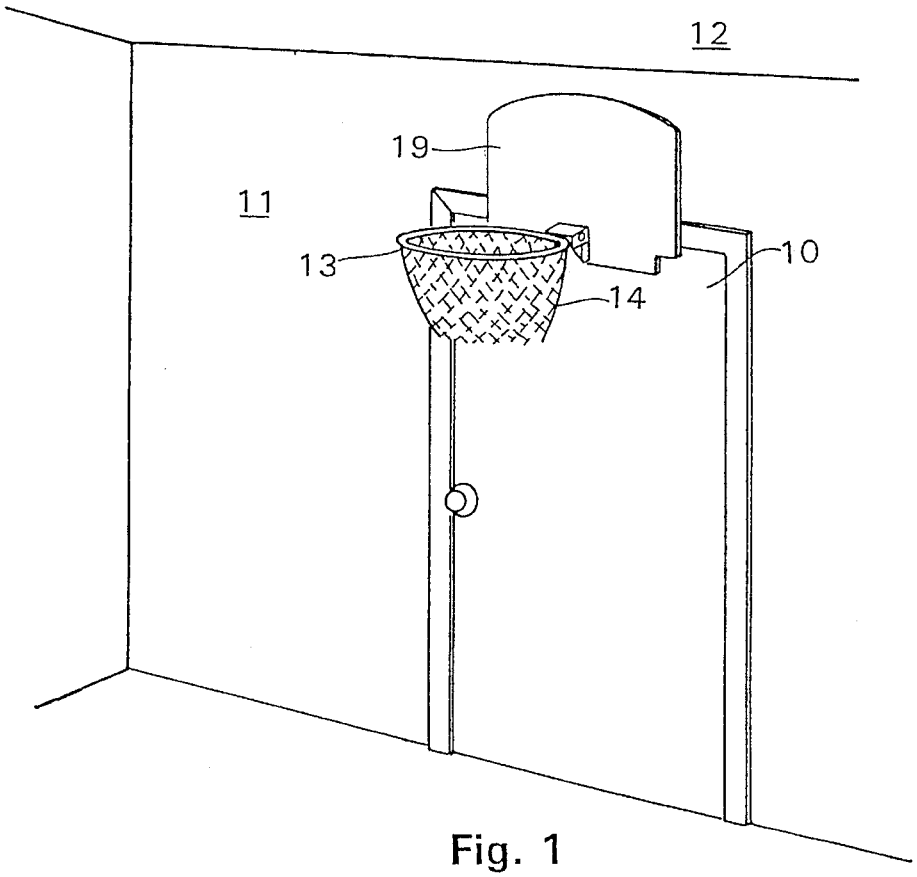
FIG. 1 illustrates an indoor play area bounded by a wall having an access door set therein, a basketball goal of adjustable height in accordance with the invention being mounted on the upper edge of the door.
Figure 2:
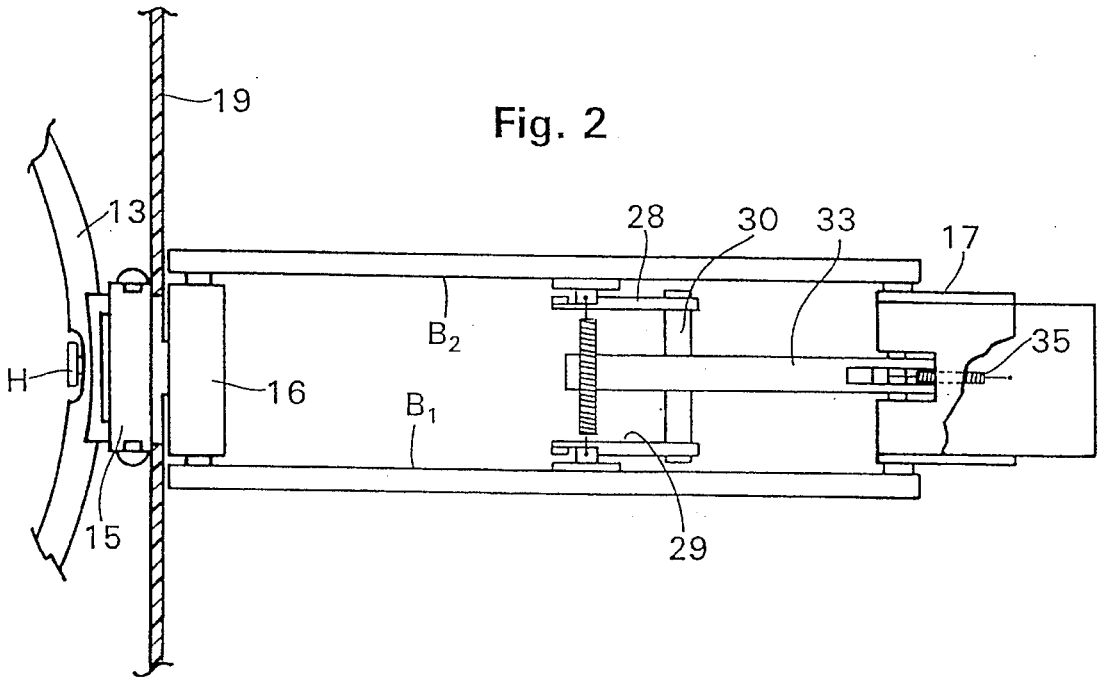
FIG. 2 is a top view of the basketball goal.
Figure 3:
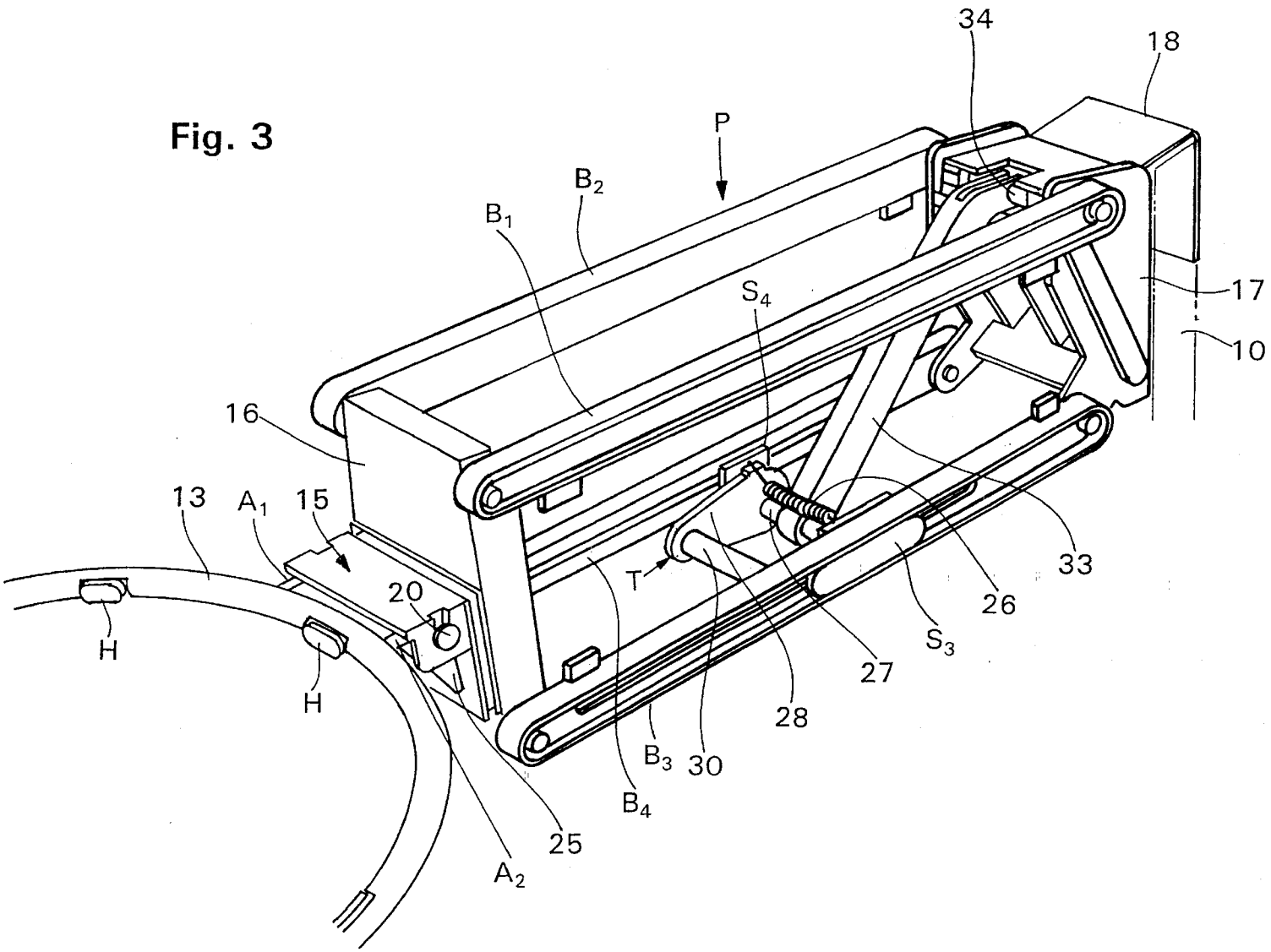
FIG. 3 is a perspective view of the goal.

The Goal:

Referring now to FIGS. 1 to 3, shown in these figures is a basketball goal of adjustable height in accordance with the invention installed on the upper edge of a hinged door 10 in a playroom or other chamber in which the door functions as an entry thereto. Door 10 is set into a room wall 11 whose upper area extends between the .upper edge of the door and the room ceiling 12. Hence there is adequate room to throw a basketball into a region above the goal.

Figure 6:
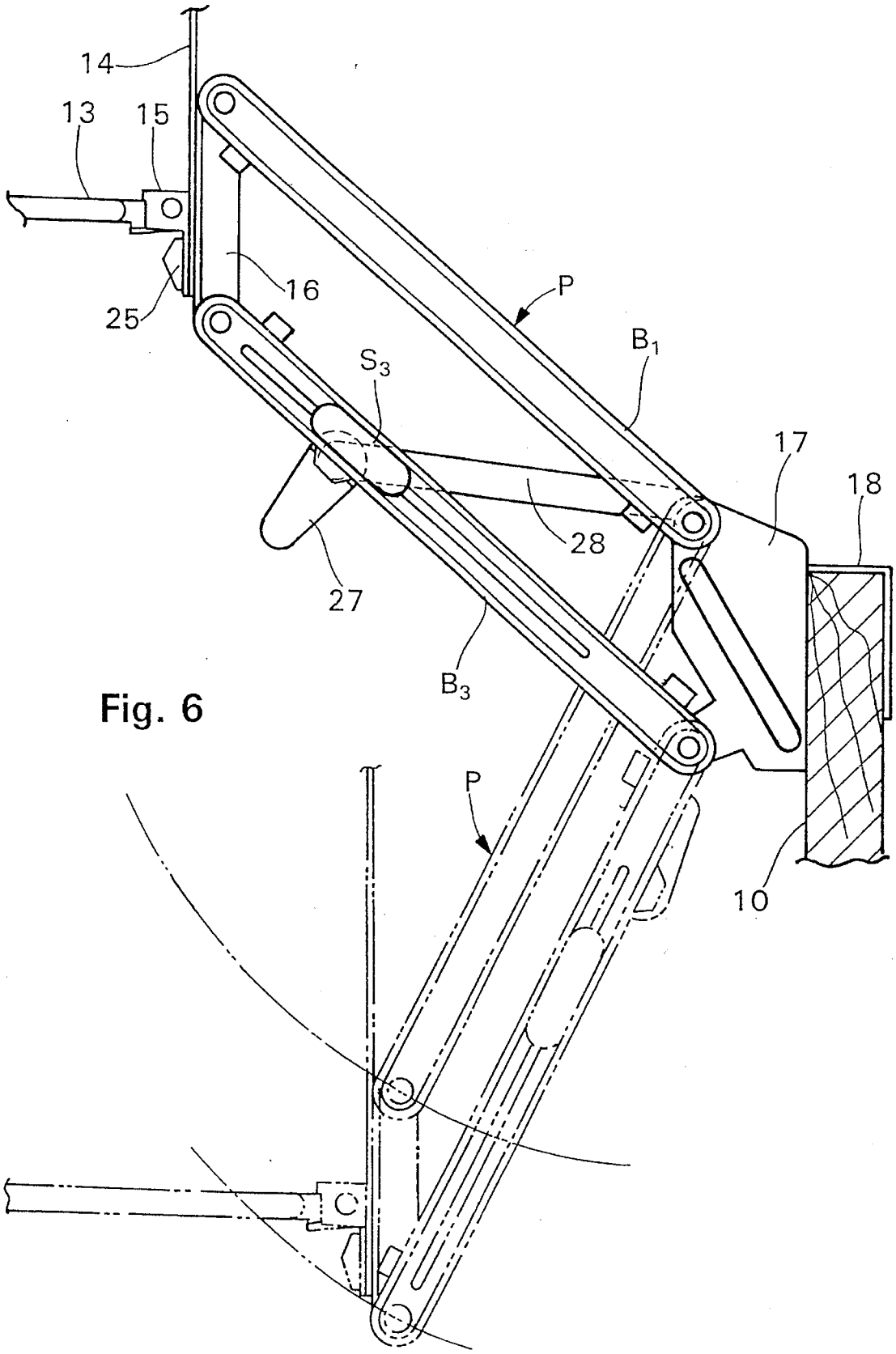
FIG. 6 is a side view of the goal showing the pantograph in solid lines in an upwardly angled position, and, also showing the pantograph in dashed lines in a downwardly angled position.

The basketball goal includes a hoop 13 from which is suspended an open mesh net 14 adapted to receive a ball thrown into the hoop. Hoop 13 is supported on a mounting fixture 15 secured to the front section 16 of a pantograph P whose rear section 17 is provided with a channel-shaped mounting bracket 18 adapted to hitch onto the upper edge of door 10, as shown in FIGS. 3 and 6. Hence when the door is closed, the goal is firmly supported and the hoop 17 extends outwardly from the wall in a horizontal plane.

Seated on fixture 15 is a backboard 19 provided at its lower edge with a center notch so that it can rest on the fixture. Backboard 19 is formed of pressboard or plastic, the backboard intercepting a basketball thrown at the goal.

The channel-shaped mounting bracket 18, formed of steel or other metal, is defined by rectangular front and rear plates bridged by a horizontal top plate. The width of the resultant channel is such that bracket 18 will fit neatly onto the upper edge of a door 10.

Door 10 is nested within a door jamb, there being a narrow space, as is conventional, between the upper edge of the door and the corresponding section of the door jamb. The thickness of the top plate of bracket 18 is such that it fits into this narrow space where it is sandwiched between the upper edge of the door and the door jamb without, however, wedging therebetween. Hence the door can be opened without difficulty even when the mounting bracket is installed therein.

Hoop 13 is molded of resilient, synthetic plastic material of high strength, such as polypropylene, or a plastic having similar properties. The hoop has a U-shaped cross section, the opposing walls of the hoop being bridged at spaced positions by cross members to create a circular ring highly resistant to deformation. Integral with the hoop and disposed within slots formed along the inner wall of the hoop is a series of equi-spaced hooks H each formed by a pin anchored in the hoop and having an oblong head. The open-mesh net 14 is formed of fabric cord, the upper ring of the net being suspended from these hooks.

Also integral with hoop 13 is a clevis formed by a pair of outwardly-projecting arms $A_1$ and $A_2$ having bore holes therein in axial alignment. The function of the clevis is to hingedly connect hoop 13 to fixture 15 which is also molded of synthetic plastic material.

Arms $A_1$ and $A_2$ of the clevis are linked to corresponding side walls projecting from mounting fixture 15 by hinge pins 20 and 21. Also projecting from fixture 15 just below arms $A_1$ and $A_2$ of the clevis are a pair of flexible tines 22 and 23 whose downward deflection is limited by a corresponding pair of stops 25.

Figure 4:
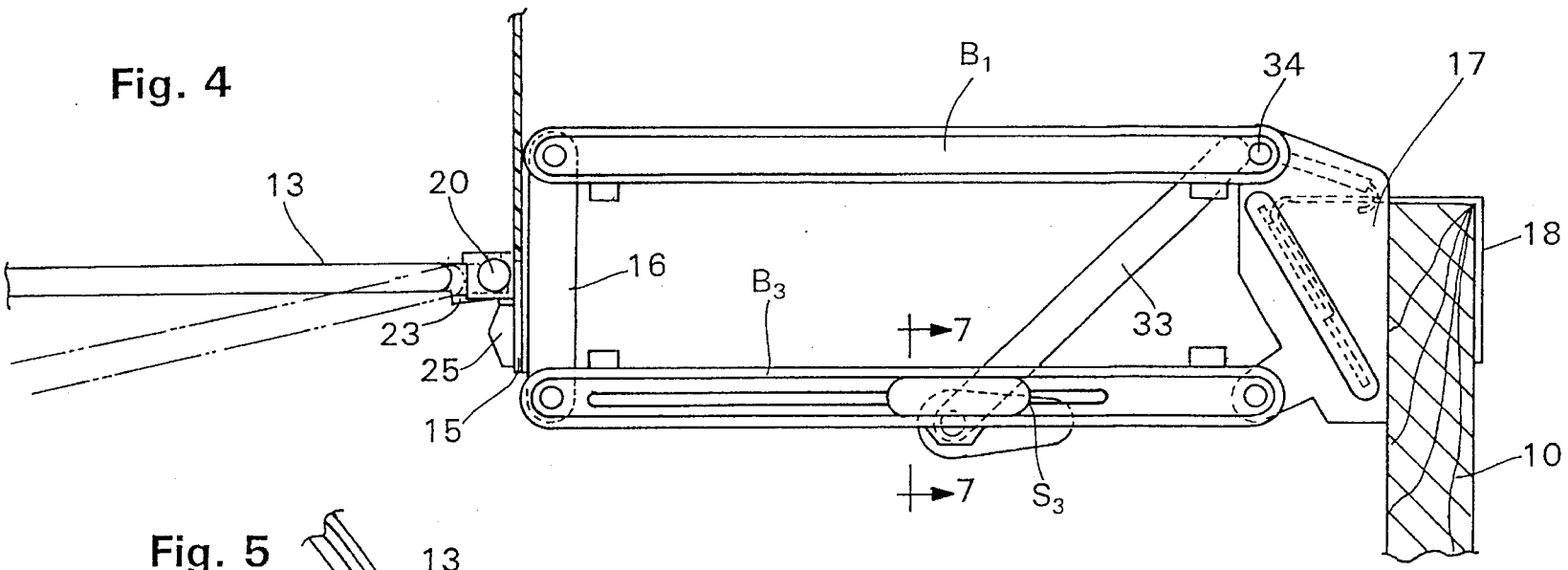
FIG. 4 is a side view of the goal when its pantograph is in a neutral position.
Figure 5:
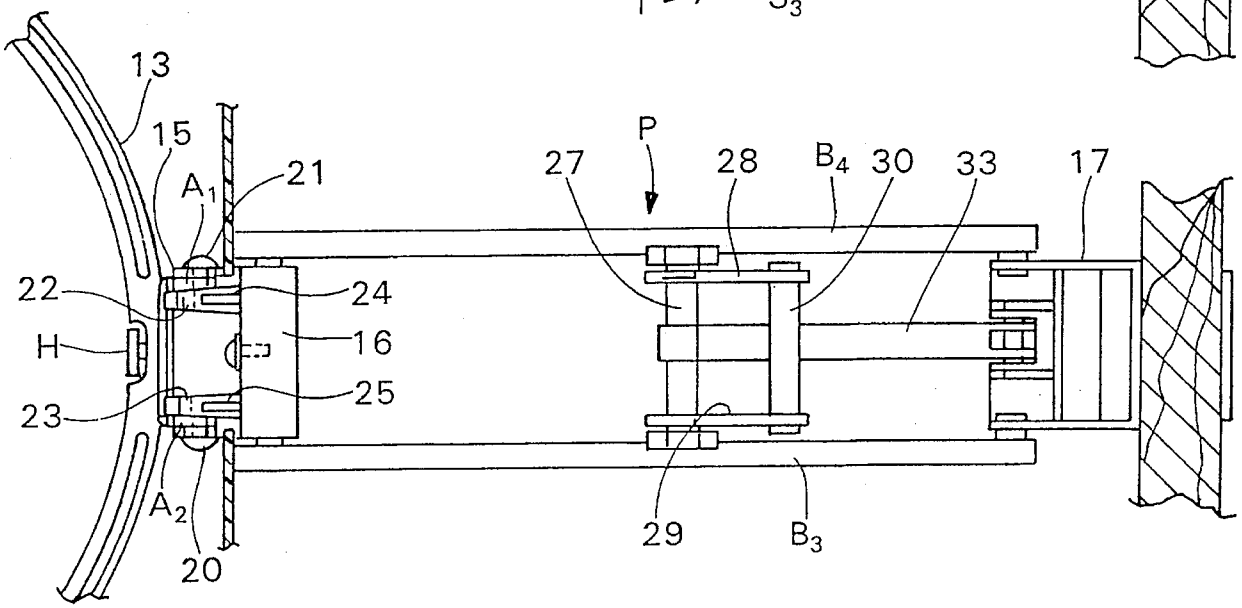
FIG. 5 is a bottom view of the goal in its neutral position.

Flexible tines 22 and 23 of fixture 15 which underlie clevis arms $A_1$ and $A_2$ of the hoop serve to normally maintain hoop 13 in a horizontal plane. When a downward force is applied by a player to hoop 13, this acts to momentarily deflect the hoop and flex tines 22 and 23, as shown in FIG. 4. The tines absorb this force, and in doing so prevent damage to the goal or injury to the player, for the hoop does not resist this force, but yields thereto. When the force is released, the hoop returns to its horizontal position. Stops 25 rojecting from fixture 15 and placed below the tines act to limit the degree of deflection.

Fixture 15 and hoop 13 are separately molded, and to combine the fixture and hoop into a goal assembly, it is only necessary to insert the clevis of the hoop into the socket of the fixture defined by its side walls so that the bores in the clevis arms register with the holes in the side walls, and then insert the pivot pins. The advantage of the door-mounted goal is that it may readily be disassembled to permit normal use of the door.

Pantograph P has a rectangular front section 16 and a rear section 17 whose rectangular dimensions match those of the front section. The front and rear sections of the pantograph are bridged by a pair of parallel upper beams $B_1$ and $B_2$ whose ends are pivotally connected by pivot pins to the upper corners of the front and rear sections 16 and 17 which are also bridged by a pair of parallel lower beams $B_3$ and $B_4$ which ends are pivotally connected by pivot pins to the lower corners of these sections. Hence in its neutral state, as shown in FIG. 3, the pantograph has the geometry of a parallelpiped.

Because of its hinged structure, the pantograph can be angled so that its front section 16 is raised or lowered with respect to its rear section 17 which is hitched onto the upper edge of door 10. But regardless of the adjusted angle, the front section is always maintained in parallel relation to the rear section which is attached to the door mounting bracket 18.

The function of pantograph P is to make it possible to raise or lower the hoop 13 supporting the net 14 to a level above or below the line of the upper edge of door 10 and thereby set the goal to an elevation suitable for play. Obviously if the height of the door on which the goal is installed is such that it is below the proper playing level, then the goal must be raised, and if it is above the proper playing level, the goal must be lowered. But if the door has a proper height, then the goal can be kept at that height.

FIG. 3 shows the pantograph P at its neutral position in which the goal elevation is then about the same as the height of door 10 and the goal projects from the door in a horizontal plane. FIG. 6 shows in solid lines the goal raised to a level above the edge of the door 10, at which level the pantograph P is unwardly angled. And it also shows in dashed lines the goal lowered to a level below the edge of the door, in which situation the pantograph P is downwardly angled.

In order to adjust the pantograph to a desired angle and to set this angle to maintain the desired elevation of the goal, the pantograph is provided with a trolley T that slides along the lower beams $B_3$ and $B_4$ which have an open track formation, the trolley including a pair of slides $S_3$ and $S_4$ each formed by an oblong section SS that slides within the related lower beam and a brake shoe section GS that slides against the inner wall of the beam. The brake shoe sections are tensioned by a helical spring 26 which prevent the shoes from pressing against the beams to brake the trolley.

Bridging slides $S_3$ and $S_4$ is a cross bar 27 (see FIGS. 3, 7 and 8) on which is pivoted a pair of crank arms 28 and 29 whose free ends are intercoupled by a handle 30. The crank arms serve as a locking mechanism which when operated act to press the brake shoes of the slides against the inner sides of the beams to arrest sliding motion and thereby lock the trolley at a desired angular setting of the pantograph.

Figure 8:
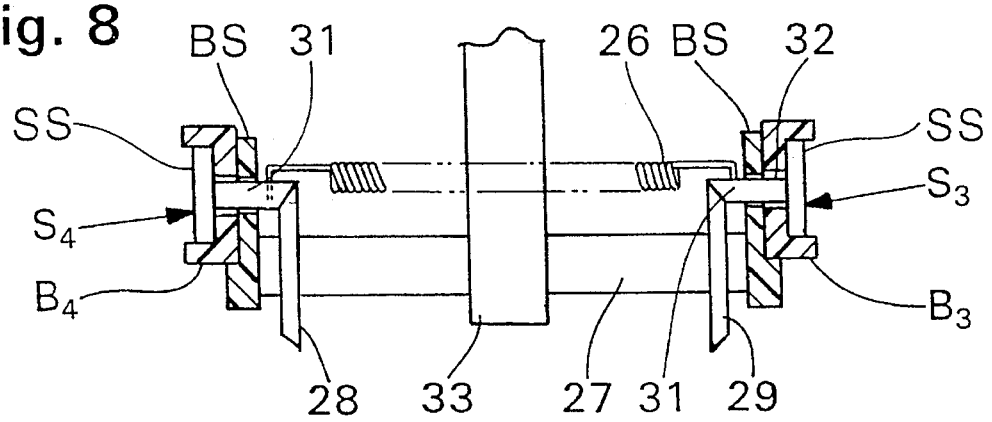
FIG. 8 is the same as FIG. 4 except that the pantograph setting is now locked.
Figure 7:
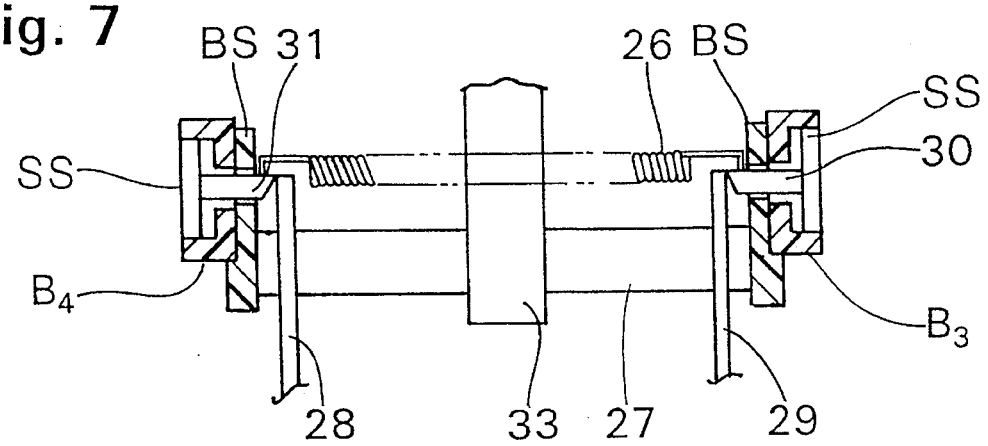
FIG. 7 is a section of the pantograph taken in the plane indicated by line 7—7 in FIG. 4.

As shown in FIGS. 7 and 8, slide sections SS of slides $S_3$ and $S_4$ are each mounted on a short shaft 31 that projects through a slot 32 in lower beams $B_3$ and $B_4$. The brake shoes BS which are adjacent the inner side of these beams are mounted on a respective shaft 31. Crank arms 28 and 29 hinged on cross bar 27 have a cam surface which engages the inclined end face of shaft 31.

When, as shown in FIGS. 3 and 7, the crank arms are horizontally oriented, non-angled portion of the crank arms 28 and 29 engage the angled end face of each shaft 31 to push each shaft 31 axially toward the beams and each side slide SS away from the beams so that no pressure is then applied thereto by side slide SS, as a result of which the spring bias applied to brake shoes BS by the tensioned helical spring 26 through side slides SS beams $B_3$ and $B_4$ is such as to prevent the brake shoes from engaging the inner sides of beams $B_3$ and $B_4$.

And when crank arms 28 and 29 are pulled by handle 30 to a vertical locking position as shown in solid in FIG. 6 and in FIG. 8, then a angled can surface portion of the crank arm cam engages the angled projecting tip of the inclined end face of short shaft 31 allowing tensioned helical spring 26 to pull shaft 31 inward and side slides SS against the beams $B_3$ and $B_4$ and thus cause brake shoes BS to press against the inner side of the beams to effect a braking action. And when the crank arms are thereafter raised to release the brake, the crank arms 28 and 29 act to disengage the brake shoes from the sides of the beams, as in FIG. 7, to permit the trolley to again slide on the beams.

The trolley, when unbraked, is free to slide in either direction along lower beams $B_3$ and $B_4$ to an extent depending on how the pantograph is angled. A push arm 33 as best seen in FIGS. 3 to 6, is situated midway between the parallel beams of the pantograph, one end of this arm being pivoted on cross bar 27 of the trolley. The other end of push arm 33 is pivoted on a cross bar 34 supported at the upper end of the rear section 17 of the pantograph. The upper beams $B_1$ and $B_2$ of the pantograph are hinged on the ends of cross bar 34.

Figure 9:
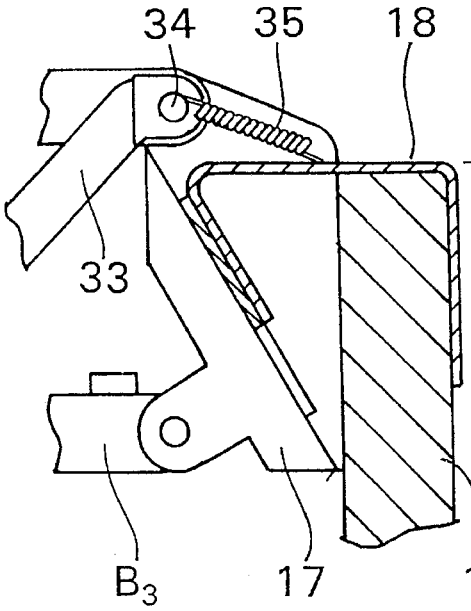
FIG. 9 shows the rear section of the pantograph in which the push rod hinged to the rear section and coupled to a trolley slidable on the pantograph is at one angle.
Figure 10:
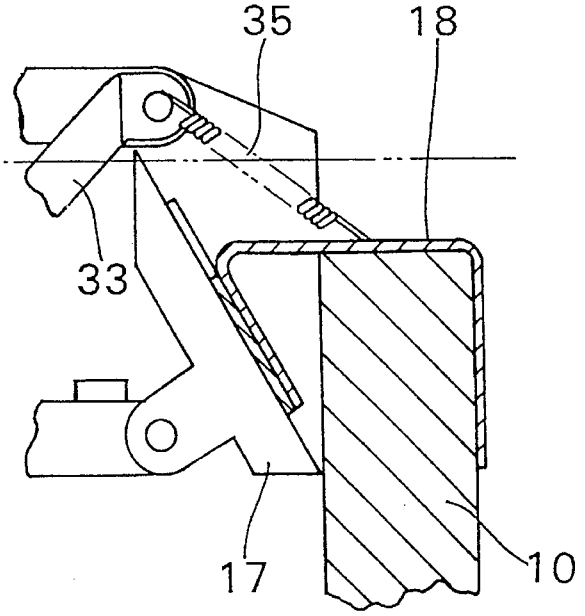
FIG. 10 is the same as FIG. 9 except that the push rod is at another angle.

As shown in FIGS. 9 and 10 a helical spring 35 is connected between cross bar 34 and the upper plate of bracket 18 mounted on the rear section 17 of the pantograph. When therefore the pantograph is angularly adjusted from the angle shown in FIG. 9 to that shown in FIG. 10, push rod 33 then advances the trolley sliding on the lower beams $B_3$ and $B_4$ in a direction and to an extent depending on the angle of adjustment, and the trolley is then locked to maintain this angle.

FIG. 6 shown in full lines the pantograph P which is hitched onto the upper edge of door 10 angularly adjusted to raise the front section 16 of the pantograph on which hoop 13 is supported to a level well above the upper edge of the door, so that the basketball goal hoop is then at an elevation above the door. FIG. 6 also shows in dashed lines the pantograph angularly adjusted so that the goal hoop is well below the upper edge of the door.

Hence the pantograph on which the hoop is mounted is adjustable to set the goal at an elevation that is suitable for play regardless of the height of the door on which the goal is hitched. And should a player slam dunk the hoop, because it is hinged into the fixture 15 and is spring biased by tines 23, the hoop will be momentarily diflected to absorb the shock, and then return to its normal horizontal position.

While there has been shown a preferred embodiment of a goal in accordance with the invention, many changes may be made thereon without departing from the spirit of the invention.

I claim:

1. A basketball goal for indoor play in an area bounded by a wall having a door set therein, said goal comprising:

A. a hoop from which a net is suspended;

B. a fixture supporting the hoop in a horizontal plane; and

C. a pantograph having a front section to which said fixture is secured and a rear section parallel to the front section to which is attached a bracket that is hitchable onto the upper edge of the door, said pantograph including angle adjusting means to raise the front section to a level above or below the rear section whereby the hoop may be set to an elevation in line with the upper edge of the door or to a higher or lower elevation suitable for play, the front and rear sections of the pantograph being generally rectangular and being bridged by a pair of parallel upper beams whose ends are pivotally connected to the upper corners of the sections and a pair of parallel lower beams whose ends are pivotally connected to the lower corners of the sections, whereby in a neutral position the pantograph has the geometry of a parallelpiped, the pantograph including a trolley that rides on the lower beams and a push rod, one end of which is hinged to the trolley and the other to said rear section, the position of the trolley on the lower beams depending on the angle of adjustment.

2. A goal as set forth in claim 1, wherein said hoop has integral therewith a clevis defined by a pair of projecting arms having bore holes therein, the arms being received in corresponding side walls in the fixture having bearing holes therein which register with said bore holes, further including hinge pins inserted in the registered holes to hinge said clevis from said fixture.

3. A goal as set forth in claim 2, wherein said fixture is provided with a pair of flexible tines which underlie the arms of the clevis to normally maintain said hoop in a horizontal plane and being flexed when a downward force is applied to the hoop to absorb this force.

4. A goal as set forth in claim 3, in which the fixture is provided with a pair of stops below the tines to limit flexure of the tines.

5. A goal as set forth in claim 1, in which the lower beams have a track-like formation and the trolley includes a pair of slides that slide along the lower beams.

6. A goal as set forth in claim 5, further including a retractable locking mechanism to hold the trolley at any set position on the lower beams.

7. A goal as set forth in claim 1, in which the hoop and the fixture are both formed of synthetic plastic material.

* * * * *